US007588394B1

(12) United States Patent
Walker et al.

(10) Patent No.: US 7,588,394 B1
(45) Date of Patent: Sep. 15, 2009

(54) LOW PROFILE MINE ROOF SUPPORT

(75) Inventors: Roland Walker, Syracuse, UT (US); Matthew S. Slatter, Salt Lake City, UT (US)

(73) Assignee: DSI Ground Support Inc., Salt Lake City, UT (US)

( * ) Notice: Subject to any disclaimer, the term of this patent is extended or adjusted under 35 U.S.C. 154(b) by 0 days.

(21) Appl. No.: 12/058,294

(22) Filed: Mar. 28, 2008

(51) Int. Cl.
*E21D 21/00* (2006.01)

(52) U.S. Cl. ..... 405/302.2; 405/302.1; 405/259.1

(58) Field of Classification Search ..... 405/302.1, 405/302.2, 259.1, 259.4
See application file for complete search history.

(56) References Cited

U.S. PATENT DOCUMENTS

| | | | | | |
|---|---|---|---|---|---|
| 5,230,589 | A | | 7/1993 | Gillespie | |
| 5,253,960 | A | * | 10/1993 | Scott | 405/302.2 |
| 5,259,703 | A | | 11/1993 | Gillespie | |
| 5,586,839 | A | * | 12/1996 | Gillespie | 405/302.2 |
| 5,769,570 | A | * | 6/1998 | Stankus et al. | 405/302.1 |
| 5,885,034 | A | * | 3/1999 | Fergusson | 405/302.1 |
| 6,322,290 | B1 | | 11/2001 | Calandra, Jr. et al. | |
| 6,402,433 | B1 | * | 6/2002 | Gillespie | 405/302.2 |
| 6,684,585 | B2 | * | 2/2004 | Campbell | 405/302.2 |
| 6,881,015 | B2 | | 4/2005 | Wallstein et al. | |
| 6,957,931 | B2 | | 10/2005 | Slater | |
| 7,001,109 | B2 | * | 2/2006 | Mongrain | 405/302.1 |
| 7,270,501 | B2 | * | 9/2007 | Kanflod et al. | 405/302.1 |
| 2007/0036617 | A1 | | 2/2007 | Oldsen et al. | |

FOREIGN PATENT DOCUMENTS

| | | |
|---|---|---|
| AU | 6747581 | 2/1980 |

* cited by examiner

*Primary Examiner*—Frederick L Lagman
(74) *Attorney, Agent, or Firm*—Marshall, Gerstein & Borun LLP

(57) ABSTRACT

A low-profile mine roof support device comprises a roof plate and a barrel. The barrel includes a nose portion, a shoulder portion, and a tapered bore for receiving a cable to secure the roof plate to the mine roof. The shoulder portion of the barrel comprises a convex surface that seats against the plate. So configured, a majority of the barrel, which includes the nose portion and the tapered bore, passes through the plate and into a drilled hole formed in the mine roof, thereby advantageously minimizing the extent to which the support device extends into the workspace of the mine without sacrificing the length of the barrel.

48 Claims, 5 Drawing Sheets

LOW PROFILE MINE ROOF SUPPORT

FIELD OF THE DISCLOSURE

The present disclosure relates generally to roof support devices used in underground mining operations, and more particularly, to low-profile roof support devices.

BACKGROUND

In mining operations, bolts are often used to support the roof of the mine. Typically, a bore is drilled into the rock formation that forms the mine roof, and then a mine roof bolt is placed in the bore and secured by a fast-curing resin material or other suitable substance. The roof bolt, which can be formed of wire strands woven or wound together to form a cable, engages a widened bearing plate that bears against a portion of the roof, thus holding a portion of the roof in place.

One approach for installing such bolts is to drill an over-sized bore into the rock and then insert one or more resin cartridges into the bore. The elongated cable portion of the mine roof bolt is then forced into the bore, and rotated. This process ruptures the resin cartridges and mixes the two resin components together within the space between the cable portion of the bolt structure and the over-sized bore.

Such systems typically include a wedge barrel. The wedge barrel provides a bearing surface so that the tensile load carried by the elongated cable bolt can be suitably transferred to the bearing plate. The wedge barrel is commonly joined to the cable bolt by a plurality of wedges which are wedged between the cable itself and an inside tapered surface of the wedge barrel prior to installation of the roof bolt. Using a suitable tool, the wedge barrel is spun to rotate the cable within the bore as mentioned above. So configured, the bearing plate and wedge barrel can intrude upon the workspace within the mine because they extend below the mine roof.

SUMMARY

The present disclosure provides a low-profile mine roof support device comprising a plate and a barrel. The plate comprises a bore and a seating surface disposed adjacent to the bore and is adapted to be abutted against a mine roof. The barrel comprises a first end and a second end. The barrel defines a nose portion disposed at the first end and a shoulder portion disposed at the second end. The nose portion defines a tapered bore adapted to receive a cable and at least one wedge for securing the cable in the barrel and the plate against the mine roof. The shoulder portion can comprise either a recess for receiving an internal drive mechanism or a nut for accommodating an external drive mechanism, and additionally defines a convex external surface. The convex external surface of the shoulder portion has an average diameter that is greater than an average diameter of the nose portion such that it removably engages the seating surface of the plate. So disposed, the nose portion passes through the plate and a majority of the barrel extends beyond the plate away from the shoulder portion and into a drilled hole in the mine roof, thereby minimizing the extent to which the barrel extends into the workspace of the mine.

DETAILED DESCRIPTION

The examples described herein are not intended to be exhaustive or to limit the scope of the invention to the precise form or forms disclosed. Rather, the following embodiments have been chosen to provide examples to those having ordinary skill in the art.

Figure 2:
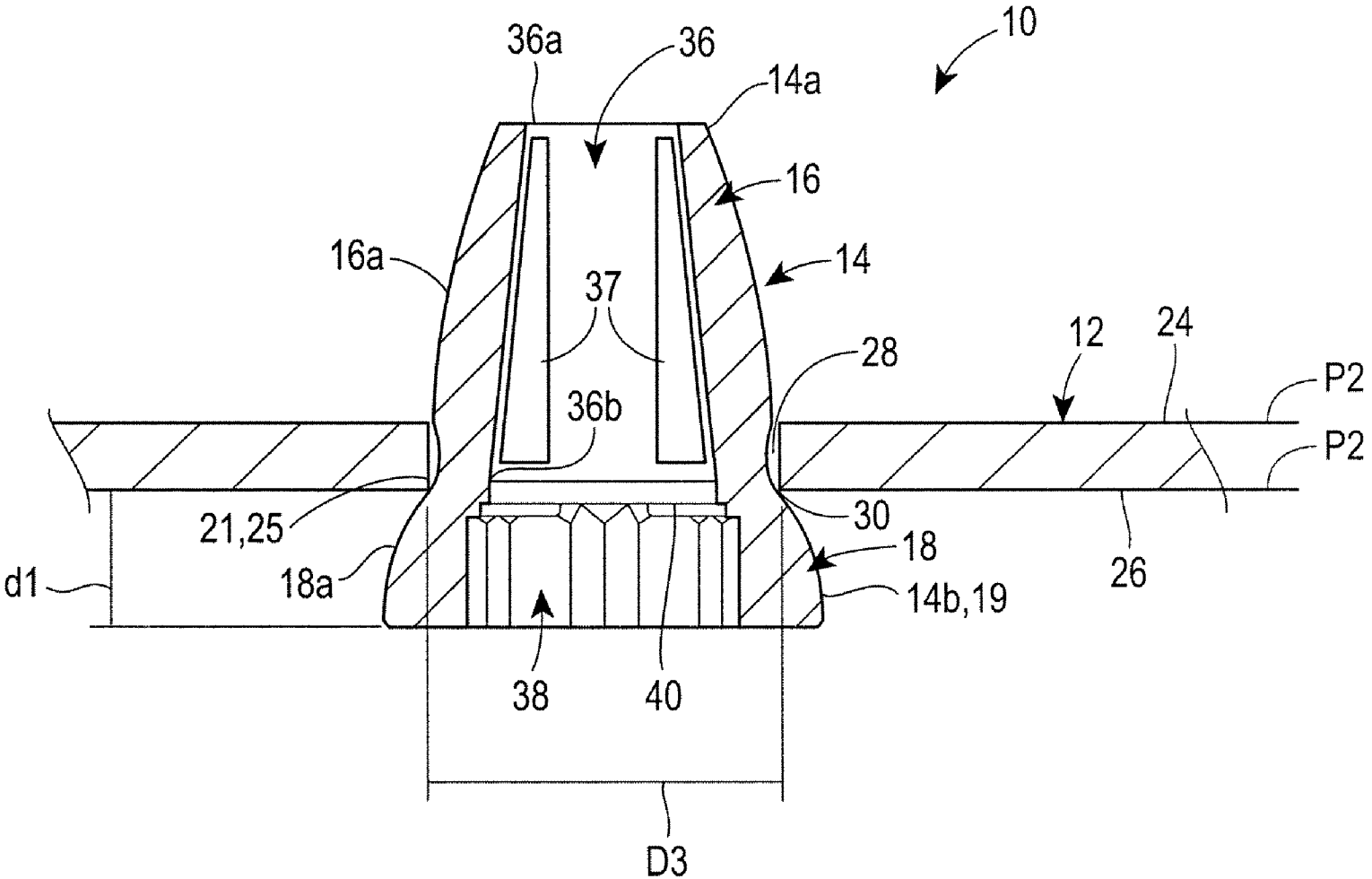
FIG. 2 is a side cross-sectional view of one embodiment of a mine roof support device constructed in accordance with the principles of the present invention and including the wedge barrel of FIG. 1 and a roof plate.

FIG. 2 depicts one embodiment of a low-profile mine roof support device 10 constructed in accordance with the present invention. Generally speaking, the support device 10 comprises a roof plate 12 and a wedge barrel 14, which is referred to hereinafter simply as a "barrel." As will be described, the barrel 14 is generally bell-shaped and includes a tapered bore 36 for receiving a cable (not shown) or other tensioning device that is suspended from a mine roof. The tapered bore 36 also receives one or more wedges 37, as is known within the art, to secure the cable to the barrel 14. So configured, the roof plate 12 is adapted to engage the mine roof to provide support thereto.

Figure 1:
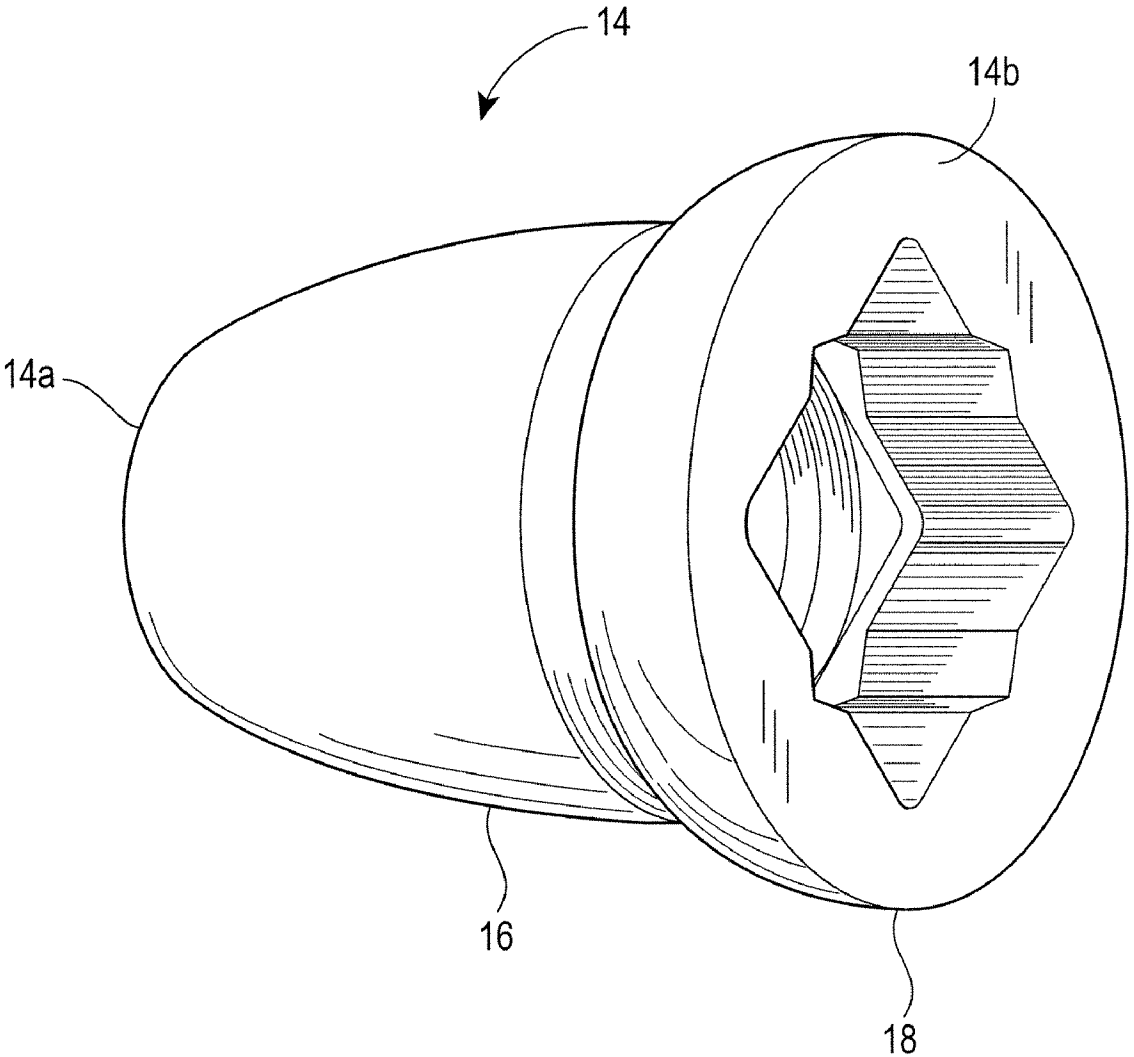
FIG. 1 is a perspective view of one embodiment of a wedge barrel of a mine roof support device constructed in accordance with the principles of the present invention.

Referring now to FIGS. 1 and 2, the barrel 14 comprises a first end 14*a* and a second end 14*b*. A nose portion 16 is disposed at the first end 14*a* of the barrel 14 and a shoulder portion 18 is disposed at the second end 14*b* of the barrel 14. The nose portion 16 and the shoulder portion 18 meet at an annular concave interface, which is identified by reference numeral 21 in FIGS. 2 and 4. The shoulder portion 18 comprises a partially round body with an external surface 18*a*, which in the disclosed embodiment, comprises a convex surface. The nose portion 16 comprises a tapered body with an external surface 16*a*, which in the disclosed embodiment, also comprises a convex surface.

Figure 4:
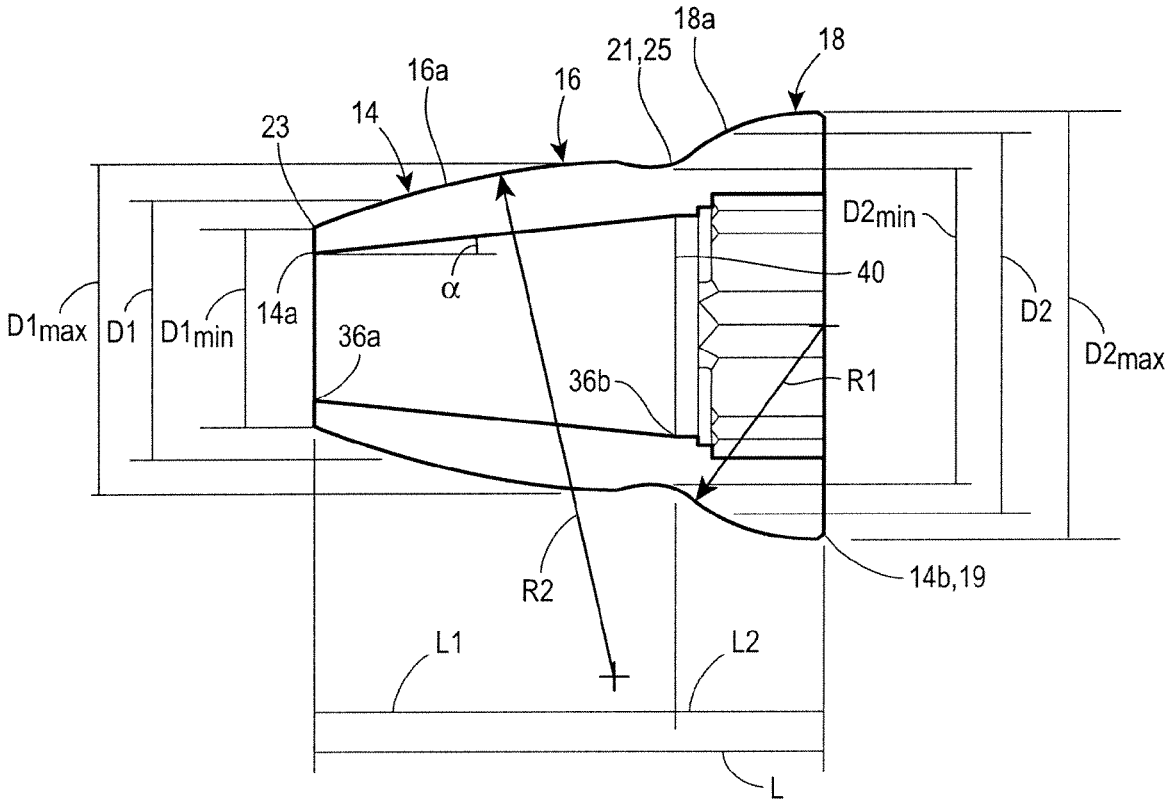
FIG. 4 is a side cross-sectional side view of the wedge barrel of FIG. 1.

As illustrated in FIG. 4, the convex external surface 18*a* of the shoulder portion 18 includes a side profile having a radius R1. The convex external surface 16*a* of the nose portion 16 includes a side profile having a radius R2. In this embodiment, the radius R1 of the convex external surface 18*a* of the shoulder portion 18 is smaller than the radius R2 of the convex external surface 16*a* of the nose portion 16. Additionally, as depicted in FIG. 4, the barrel 14 has a longitudinal dimension L, the nose portion 16 has a longitudinal dimension L1, and the shoulder portion 18 has a longitudinal dimension L2. In the disclosed embodiment, the longitudinal dimension L1 of the nose portion 16 is larger than the longitudinal dimension L2 of the shoulder portion 18. Therefore, the nose portion 16 constitutes a majority of the longitudinal dimension L of the barrel 14.

Further still, as depicted in FIG. 4, the convex external surface 16*a* of the nose portion 16 generally converges along radius R1 from near the interface 21 adjacent to the shoulder portion 18 to an annular convex bull-nose surface 23 disposed at the first end 14*a* of the barrel 14. So configured, the convex external surface 16*a* of the nose portion 16 has a maximum diameter $D1_{max}$, a minimum diameter $D1_{min}$, and an average diameter D1. The minimum diameter $D1_{min}$ of the external surface 16*a* of the nose portion 16 occurs adjacent the bull-nose surface 23 at the first end 14*a* of the barrel 14. Due to the convex curvature of the external surface 16*a* of the nose portion 16, the maximum diameter $D1_{max}$ of the nose portion 16 of the present embodiment does not occur directly at the interface 21 with the shoulder portion 18, but rather at a location slightly spaced from the interface 21 toward the first end 14*a* of the barrel 14. However, this is merely an example and other embodiments can be configured otherwise.

Similar to the external surface 16*a* of the nose portion 16, the external surface 18*a* of the shoulder portion 18 converges from a beginning end 19 disposed at the second end 14*b* of the barrel 14 to a terminal end 25 disposed at the interface 21 between the nose portion 16 and the shoulder portion 18. So configured, the convex external surface 18*a* of the shoulder portion 18 has maximum diameter $D2_{max}$, a minimum diameter $D2_{min}$, and an average diameter D2. The minimum diameter $D2_{min}$ occurs generally adjacent to the interface 21 with the nose portion 16 of the barrel 14. The maximum diameter $D2_{max}$ occurs at the beginning end 19, which constitutes the second end 14*b* of the barrel 14. The average diameter D2 of the convex external surface 18*a* of the shoulder portion 18 is larger than the average diameter D1 of the convex external surface 16*a* of the nose portion 16.

Referring back to FIG. 2, the roof plate 12 of one embodiment of the roof support device 10 includes a generally flat plate comprising a first surface 24, a second surface 26, and a through-bore 28. The first surface 24 of the plate 12 is disposed within a first plane P1 at least in the region immediately surrounding the through-bore 28. The second surface 26 of the plate 12 is disposed in a second plane P2 at least in the region immediately surrounding the through-bore 28. A "plane," as used herein, is understood by one of ordinary skill in the art as a two-dimensional surface of infinite dimension and having generally zero curvature within suitable tolerances for the given application.

In the disclosed embodiment, the first plane P1 is parallel to the second plane P2 such that the first and second surfaces 24, 26 are parallel to each other at least in the region immediately surrounding the through-bore 28. The through-bore 28 comprises a generally cylindrical bore extending between the first and second surfaces 24, 26 of the roof plate 12. Accordingly, the roof plate 12 defines a circular seating surface 30 at the interface between the second surface 26 and the through-bore 28. The through-bore 28 and seating surface 30 each have a diameter D3 sized and configured to receive the nose portion 16 of the barrel 14. Therefore, the diameter D3 of the through-bore 28 and seating surface 30 is larger than the maximum diameter $D1_{max}$ of the external surface 16*a* of the nose portion 16.

Moreover, the diameter D3 of the through-bore 28 and seating surface 30 is larger than the minimum diameter $D2_{min}$ of the external surface 18*a* of the shoulder portion, as well as smaller than the maximum diameter $D2_{max}$ of the external surface 18*a* of the shoulder portion 18. So configured, the shoulder portion 18 seats against the seating surface 30, and more particularly, the external surface 18*a* of the shoulder portion 18 seats against the seating surface 30. Because the external surface 18*a* of the disclosed embodiment of the shoulder portion 18 is convex, the barrel 14 can pivot relative to the plate 12.

Finally, as mentioned above, the barrel 14 of the presently disclosed embodiment of the roof support device 10 further includes the bore 36 for receiving a cable and accommodating the wedges 37. Moreover, the barrel 14 includes a recess 38 for receiving a nut (not shown) or wrench (not shown) of an internal drive mechanism, for example, which can be used to secure the mine roof support device 10 to a mine roof.

The bore 36 comprises a tapered bore that diverges from the first end 14*a* of the barrel 14 toward the second end 14*b* of the barrel 14. More specifically, with reference to FIG. 2, the bore 36 includes a first end 36*a* and a second end 36*b*. The first end 36*a* is disposed at the first end 14*a* of the barrel 14. The second end 36*b* is disposed generally at the interface 21 between the nose portion 16 and the shoulder portion 18 of the barrel 14. So disposed, the bore 36 of the presently disclosed embodiment is completely disposed within the nose portion 16 of the barrel 14, and therefore extends from a location disposed within the bore 28 of the roof plate 12 to a location opposite the roof plate 12 from the shoulder portion 18 of the barrel 14. As illustrated in FIG. 4, the tapered bore 36 of the present embodiment diverges at an angle $\alpha$ that is in the range of approximately 2° to approximately 20°, and in one embodiment can be approximately 7°.

Figure 3:
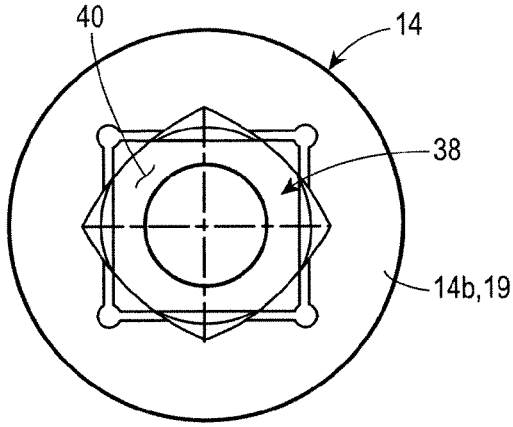
FIG. 3 is an end view of a shoulder portion of the wedge barrel of FIG. 1.

As illustrated in FIG. 3, the recess 38 is disposed within the second end 14*b* of the barrel 14, which also constitutes the beginning end 19 of the shoulder portion 18, and comprises a square cross-section and a floor 40. The floor 40 is spaced from the second end 14*b* of the barrel 14 such that the recess 38 is adapted to receive a nut (not shown) or wrench (not shown), as mentioned above, thereby defining what can be considered an "internal drive" barrel 14. The nut is for accommodating a portion of the tensioning cable suspended from the mine roof as described in commonly owned U.S. Pat. No. 6,881,015 entitled "Wedge Barrel For a Mine Roof Cable Bolt," issued Apr. 19, 2005, the entire contents of which are hereby incorporated herein by reference.

Figure 5:
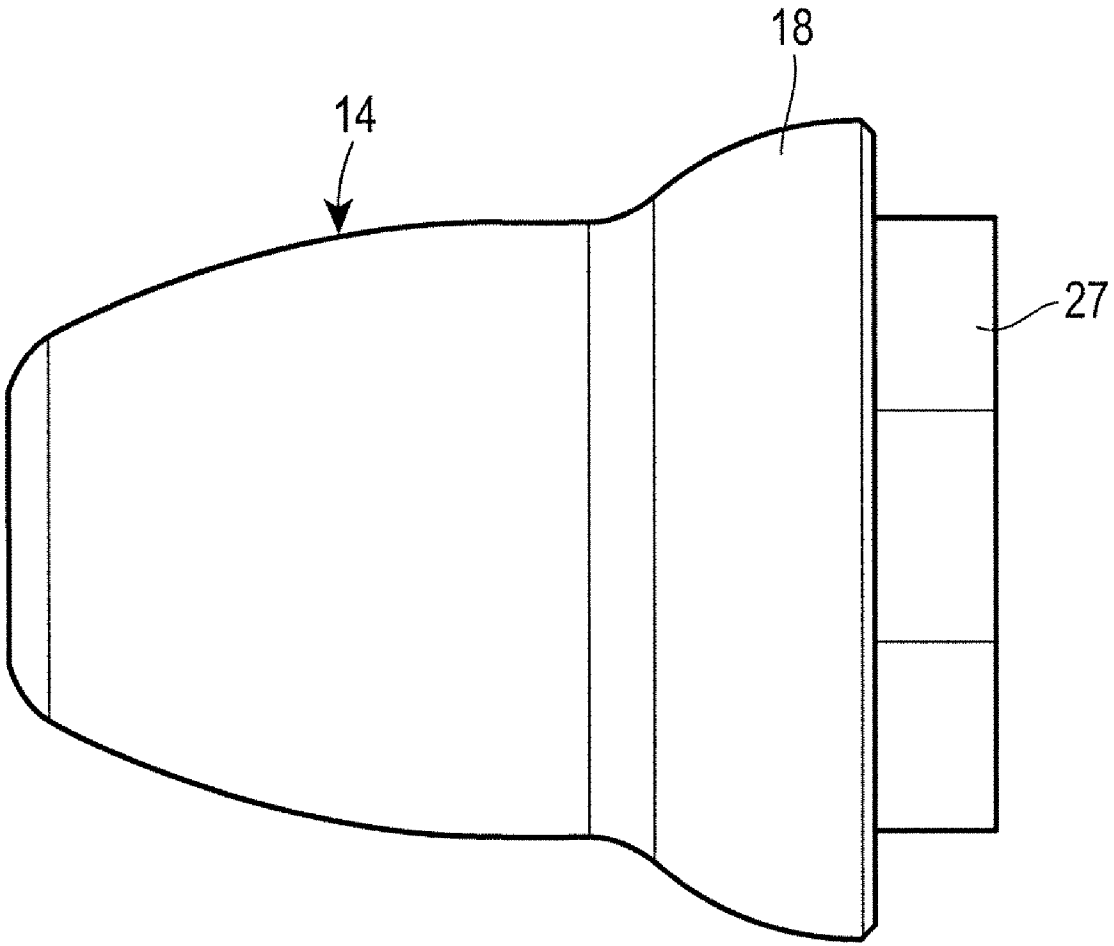
FIG. 5 is a side view of an alternative embodiment of a wedge barrel of a mine roof support device constructed in accordance with the principles of the present invention.

While the recess 38 has been described as including a square cross-section, other configurations are intended to be within the scope of the invention. Further, while the barrel 14 has been described as including the recess 38 for receiving a nut or wrench, for example, thereby defining an "internal drive" barrel 14, an alternative embodiment of the barrel 14 can comprise an "external drive." For example, one alternative embodiment of the barrel 14 can include the shoulder portion 18 of the barrel 14 being shaped to accept an external drive mechanism. For example, FIG. 5 depicts an embodiment wherein the shoulder portion 18 of the barrel 14 includes a hexagonally-shaped nut 27 formed integrally therewith. In a further alternative embodiment, the nut 27 can be separate from the shoulder portion 18 of the barrel 14. Therefore, it should be understood that the barrel 14 of the present disclosure is not limited to internal drive or external drive mechanisms.

Referring back to FIG. 2, during use, the first surface 24 of the roof plate 12 is adapted to be abutted against a mine roof (not shown). The mine roof would include an elongated bore receiving a tensioning cable, for example, as described above. Additionally, the mine roof can include an enlarged recess immediately adjacent the mine cavity adapted to receive the nose portion 16 of the barrel 14. In alternative embodiments, the nose portion 16 of the barrel 14 may simply be disposed within same elongated bore as the tensioning cable.

Nevertheless, the cable (not shown) that suspends from the mine roof is received within the tapered bore 36 of the barrel 14 and secured thereto with the wedges 37 in a known manner. The thrust from the bolter seats the barrel 14 against the roof plate 12. As described above, the external surface 18*a* of the shoulder portion 18 of the barrel 14 seats against the seating surface 30 of the roof plate 12. More specifically, because the seating surface 30 of the presently disclosed embodiment is defined by the interface between the second surface 26 of the roof plate 12 and the through-bore 28, the seating surface comprises a circular edge of the roof plate 12. So configured, the convex external surface 18*a* of the shoulder portion 18 of the barrel 14 is in line contact with the seating surface 30. During installation, the curvature of the external surface 18*a* can advantageously assist in aligning the barrel 14 relative to the roof plate 12 even when the mine roof, for example, is not very flat. Moreover, the line contact between the shoulder portion 18 of the barrel 14 and the seating surface 30 of the roof plate 12 minimizes friction therebetween, which can also assist in aligning the barrel 14 relative to the roof plate 12 during installation by enabling the barrel 14 to easily pivot relative to the roof plate 12 if required. Furthermore, the generally tapered external surface 16*a* of the nose portion 16 can assist in the installation of the roof support device 10 by facilitating alignment of the barrel 14 with the bore 28 in the plate 12.

Still referring to FIG. 2, with the barrel 14 installed, the shoulder portion 18 of the barrel 14 intersects the second surface 26 of the roof plate 12, such that the terminal end 25 of the shoulder portion 18 is disposed inside of the through-bore 28, i.e., between the first and second surfaces 24, 26 of the plate 12. The nose portion 16 of the barrel 14 therefore extends from a location that is inside of the through-bore 28, i.e., between the first and second surfaces 24, 26 of the plate 12, to a location that is beyond the first surface 24 and opposite the roof plate 12 from the shoulder portion 18.

More specifically, the nose portion 16 intersects the first surface 24 of the roof plate 12, thereby also intersecting the first plane P1. No portion of either the nose portion 16, the tapered bore 36, or the wedges 37 extends beyond the second surface 26 of the plate 12 toward the shoulder portion 18 of the barrel 14. In fact, as depicted in FIG. 2, a majority of the nose portion 16 and a majority of the barrel 14 is disposed opposite the roof plate 12 from the shoulder portion 18 of the barrel 14. Further, because the tapered bore 36 is completely disposed within the nose portion 16, the tapered bore 36 also intersects the first surface 24 of the roof plate 12 and the first plane P1. Therefore, a majority of the tapered bore 36 is also disposed opposite the roof plate 12 from the shoulder portion 18 of the barrel 14. So configured, only a minor portion of the barrel 14, which comprises the portion of the shoulder portion 18 extends beyond the second surface 26 of the roof plate 12, penetrates into the workspace of the mine. This advantageously reduces the extent to which the barrel 14 can interfere with regular mining activities.

Additionally, as depicted in FIG. 2, the wedges 37 of the presently disclosed embodiment intersect the first surface 24 of the plate 12 such that a majority of the wedges 37 are disposed opposite the roof plate 12 from the shoulder portion 18 of the barrel 14.

Referring back to FIG. 4, in a preferred embodiment, the longitudinal dimension L of the barrel 14 is approximately 2.39" (60.6 mm), the longitudinal dimension L1 nose portion 16 is approximately 1.71" (43.4 mm), the longitudinal dimension L2 of the shoulder portion 18 is approximately 0.68" (17.2 mm). Therefore, in a preferred embodiment of the barrel 14, an aspect ratio of the barrel 14 to the shoulder portion 18 can be approximately 3.5:1, an aspect ratio of the barrel 14 to the nose portion 16 can be approximately 1.5:1, and preferably approximately 1.4:1, and an aspect ratio of the nose portion 16 to the shoulder portion 18 can be approximately 2.5:1.

Moreover, preferably, the radius R1 of the profile of the external surface 18*a* of the shoulder portion 18 is approximately 1.0" (25.4 mm), the radius R2 of the external surface 16*a* of the nose portion 16 is approximately 3.5" (88.9 mm), a radius of the concave interface 21 between the shoulder portion 18 and the nose portion 16 can be approximately 0.25" (6.4 mm), and a radius of the convex bull-nosed surface 23 disposed at the first end 14*a* of the barrel 14 can be approximately 0.19" (4.8 mm). The minimum diameter $D1_{min}$ of the external surface 16*a* of the nose portion 16 can be approximately 1.03" (26.3 mm), the maximum diameter $D1_{max}$ of the external surface 16*a* of the nose portion 16 can be approximately 1.72" (43.7 mm), and the average diameter D1 of the external surface 16*a* of the nose portion 16 can be approximately 1.38" (35 mm). The minimum diameter $D2_{min}$ of the external surface 18*a* of the shoulder portion 18 can be approximately 1.62" (41.2 mm), the maximum diameter $D2_{max}$ of the external surface 18*a* of the shoulder portion 18 can be approximately 2.12" (53.9 mm), and the average diameter D2 of the external surface 18*a* of the shoulder portion 18 can be approximately 1.87" (47.5 mm).

One advantage provided by the disclosed embodiment of the mine roof support device 10 is that it extends a shorter distance below the mine roof and into the mine than a conventional mine roof support device. Conventional mine roof support devices can extend in the range of approximately 2.2" (5.5 cm) to approximately 2.6" (6.6 cm) below the mine roof. To the contrary, because the disclosed embodiment of the barrel 14 includes a nose portion 16 that extends substantially through the plate and into the mine roof, and which completely contains the tapered bore 25, the shoulder portion 18 only requires a minimal longitudinal dimension L2 such that the shoulder portion 18 only extends approximately 0.64" (16.2 mm) below the second surface 26 of the roof plate 12. In the embodiment depicted in FIGS. 1-4, the longitudinal dimension L2 of the shoulder portion 18 of the barrel 14 can be dictated by the nut (not shown) of the internal drive mechanism that it must receive. However, the shoulder portion 18 of the embodiment of the barrel depicted in FIG. 5 could foreseeably include a shorter longitudinal dimension because it no longer needs to define the recess 38.

Therefore, in light of the foregoing, a mine roof support device 10 constructed in accordance with the disclosed embodiment provides for a low-profile mine roof support 10 that can be installed adjacent an underground mine roof with minimal intrusion into the workspace of the mine.

In addition, the presently disclosed barrels 14 reduce the extent to which the barrel 14 extends into the workspace of the mine without substantially sacrificing the working length of the tapered bore 36. For example, conventional barrels can have a total barrel length of approximately 2.7" (6.92 cm), while the disclosed embodiment of the barrel 14 includes an overall length L of approximately 2.39" (60.6 mm). Thus, the barrel 14 is sufficiently dimensioned to define an internal bore 36 that is sufficiently dimensioned to receive conventional wedges 37 and generate sufficient force to secure a tensioning cable therein while minimizing mine intrusion. In the disclosed embodiment, the tapered bore 36 includes a longitudinal dimension that is approximately equal to the longitudinal dimension L1 of the nose portion 16, which is approximately 1.71" (43.4 mm). Additionally, in a preferred embodiment, the first end 36*a* of the tapered bore 36 includes a diameter of approximately 0.71" (17.9 mm), and the second end 36*b* includes a diameter of approximately 1.125" (28.6 mm).

Moreover, as described, the line contact between the convex external surface 18*a* of the shoulder portion 18 of the barrel 14 and the seating surface 30 of the plate 12 provides for reduced friction to enable the barrel 14 to easily align itself during installation. However, alternative embodiments of the seating surface 30 can include geometries other than the circular edge between the through-bore 28 and the second surface 26 of the plate 12. For example, the seating surface 30 can include a frustoconical surface, which would provide a surface contact between the barrel 14 and the roof plate 12. Another alternative seating surface 30 could include a rounded surface, i.e., a bull-nosed surface, which would also provide a line contact. Therefore, the seating surface 30 is not limited to that which is described herein.

While the roof plate 12 has been disclosed herein as comprising first and second surfaces 24, 26 disposed in parallel planes P1, P2, respectively, in the region surrounding the through-bore 28, an alternative embodiment of the roof plate 12 can include first and second surfaces 24, 26 completely disposed within the respective first and second planes P1, P2.

Figure 6:
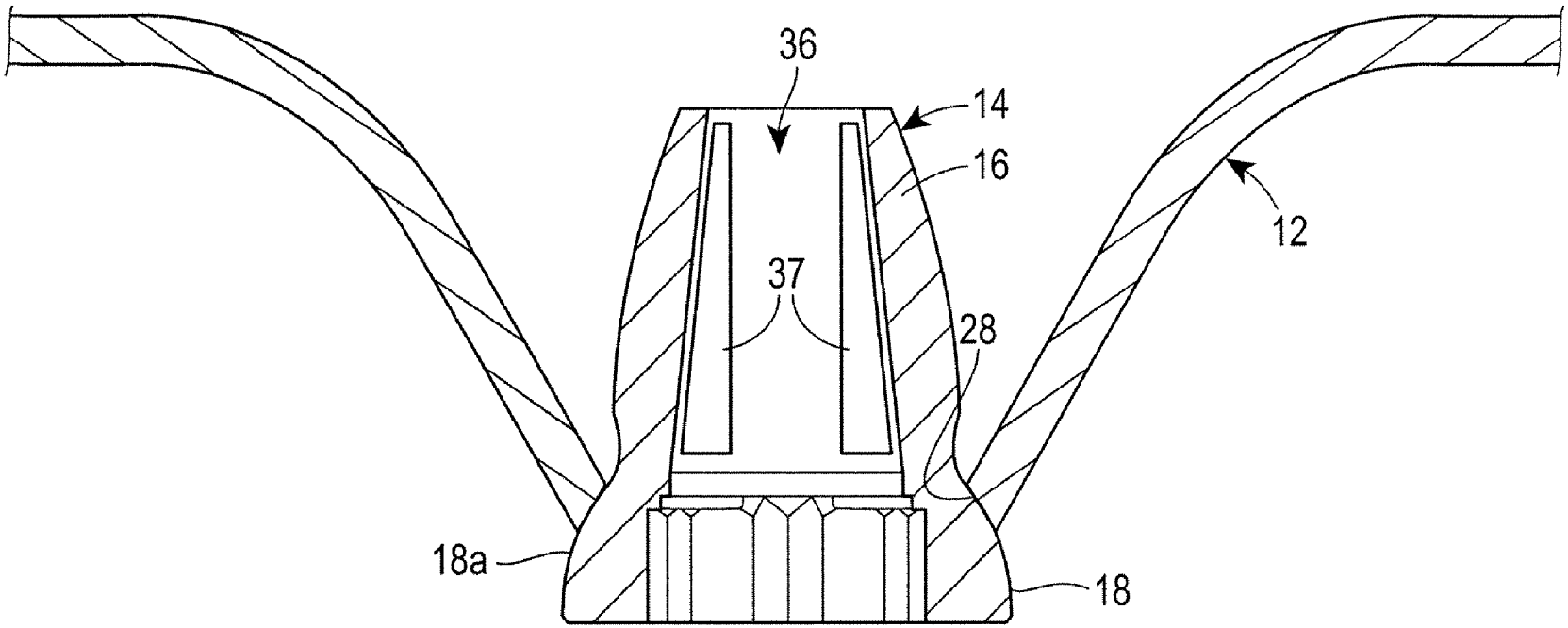
FIG. 6 is a side cross-sectional view of another alternative embodiment of a mine roof support device constructed in accordance with the principles of the present invention including the wedge barrel of FIG. 1 and an alternative roof plate.

Moreover, in a further alternative embodiment, the roof plate 12 can include a curved roof plate such as that depicted in FIG. 6 and disclosed in commonly owned U.S. Pat. No. 6,881,015, entitled "Wedge Barrel For Mine Roof Cable Bolt," the entire contents of which is hereby incorporated herein by reference.

Generally, the arrangement of the barrel 14 and the roof plate 12 depicted in FIG. 6 is the same as that described above with reference to FIG. 2, except for the fact that no portion of either the nose portion 16, the tapered bore 36, or the wedges 37 is disposed within the bore 28 in the roof plate 12. That is, the nose portion 16, the tapered bore 36, and the wedges 37 are completely disposed opposite the plate 12 from the shoulder portion 18 of the barrel 14.

While the roof plate 12 depicted in FIG. 6 is illustrated as providing surface contact with the external surface 18*a* of the shoulder portion 18 of the barrel 14, an alternative embodiment of the through-bore 28 in the roof plate 12 can be altered to provide a line of contact similar to that which was described above with reference to the embodiments depicted in FIGS. 1-5.

Finally, while the nose and shoulder portions 16, 18 of the barrel 14 have been described herein as including convex external surfaces 16*a*, 18*a*, alternative embodiments can be otherwise designed. For example, in one embodiment, either or both of the nose and shoulder portions 16, 18 can be generally frustoconical external surfaces 16*a*, 18*a*. In another alternative embodiment, the nose portion 16 can have a generally frustoconical external surface 16*a* and the shoulder portion 18 can have any other shape external surface 18*a*. Therefore, the invention is not limited to the specific embodiments disclosed herein.

Accordingly, it will be appreciated that the details of the various embodiments discussed herein are not intended to be mutually exclusive. Thus, various aspects and details of the disclosed examples can be interchanged.

Numerous additional modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A low-profile mine roof support device, comprising:

a plate comprising a bore and a seating surface disposed adjacent to the bore, the plate adapted to be abutted against a mine roof for supporting the mine roof;

a barrel comprising a first end and a second end;

a shoulder portion disposed at the second end of the barrel, the shoulder portion defining a convex external surface removably engaging the seating surface of the plate such as to position the barrel within the bore;

a nose portion disposed at the first end of the barrel, the nose portion defining a tapered bore adapted to receive a cable for securing the plate against the mine roof, the nose portion having an external surface with a diameter that is less than a diameter of the convex external surface of the shoulder portion;

the nose portion passing through the plate such that a majority of a longitudinal dimension of the barrel is disposed opposite the plate from the shoulder portion.

2. The device of claim 1, wherein at least a majority of the nose portion of the barrel is disposed opposite the plate from the shoulder portion of the barrel.

3. The device of claim 2, wherein the entire nose portion of the barrel is disposed opposite the plate from the shoulder portion of the barrel.

4. The device of claim 1, wherein at least a majority of the tapered bore is disposed opposite the plate from the shoulder portion.

5. The device of claim 4, wherein the entire tapered bore is disposed opposite the plate from the shoulder portion.

6. The device of claim 1, wherein the tapered bore is completely disposed within the nose portion of the barrel.

7. The device of claim 1, wherein the nose portion of the barrel comprises a tapered external surface.

8. The device of claim 7, wherein the nose portion of the barrel comprises a convex external surface, the convex external surface of the nose portion comprising a profile having a radius that is larger than a radius of a profile of the convex external surface of the shoulder portion.

9. The device of claim 1, wherein the tapered bore converges from a location disposed within the bore of the plate to a location adjacent the first end of the barrel.

10. The device of claim 1, further comprising at least one wedge disposed within the tapered bore of the nose portion of the barrel for securing the cable to barrel, at least a majority of the at least one wedge being disposed opposite the plate from the shoulder portion of the barrel.

11. The device of claim 1, wherein the shoulder portion of the barrel further comprises one of a recess for receiving an internal drive mechanism and a nut for accommodating an external drive mechanism.

12. A low-profile mine roof support device, comprising:

a plate comprising a bore and a seating surface disposed adjacent the bore, the plate adapted to be abutted against a mine roof for supporting the mine roof;

a barrel comprising a first end and a second end;

a shoulder portion disposed at the second end of the barrel and comprising a convex external surface, the convex external surface of the shoulder portion disposed in engagement with the seating surface of the plate such as to removably position the barrel within the bore of the plate;

a nose portion disposed at the first end of the barrel, the nose portion comprising an external surface having a diameter that is the smaller than a diameter of the convex external surface of the shoulder portion such that at least a portion of the nose portion is disposed opposite the plate from the shoulder portion; and a tapered bore disposed within the barrel for receiving a cable for securing the cable in the barrel, wherein the tapered bore is completely disposed within the nose portion of the barrel and at least a majority of the tapered bore is disposed opposite the plate from the shoulder portion of the barrel.

13. The device of claim 12, wherein the entire tapered bore is disposed opposite the plate from the shoulder portion of the barrel.

14. The device of claim 12, wherein at least a majority of the nose portion of the barrel is disposed opposite the plate from the shoulder portion of the barrel.

15. The device of claim 14, wherein the entire nose portion of the barrel is disposed opposite the plate from the shoulder portion of the barrel.

16. The device of claim 12, further comprising at least one wedge disposed within the tapered bore of the barrel for securing the cable to barrel, at least a majority of the at least one wedge being disposed opposite the plate from the shoulder portion of the barrel.

17. A low-profile mine roof support device, comprising:

a plate comprising a bore and a seating surface disposed adjacent the bore, the plate adapted to be abutted against a mine roof for supporting the mine roof;

a barrel comprising a first end and a second end;

a shoulder portion disposed at the second end of the barrel and comprising a convex external surface, the convex external surface of the shoulder portion disposed in engagement with the seating surface of the plate such as to removably position the barrel within the bore of the plate;

a nose portion disposed at the first end of the barrel, the nose portion comprising an external surface having a diameter that is the smaller than a diameter of the convex external surface of the shoulder portion such that at least a portion of the nose portion is disposed opposite the plate from the shoulder portion; and a tapered bore disposed within the barrel for receiving a cable for securing the cable in the barrel, wherein the tapered bore converges from a location disposed within the bore of the plate to a location adjacent the first end of the barrel and at least a majority of the tapered bore is disposed opposite the plate from the shoulder portion of the barrel.

18. The device of claim 17, wherein the entire tapered bore is disposed opposite the plate from the shoulder portion of the barrel.

19. The device of claim 17, wherein at least a majority of the nose portion of the barrel is disposed opposite the plate from the shoulder portion of the barrel.

20. The device of claim 19, wherein the entire nose portion of the barrel is disposed opposite the plate from the shoulder portion of the barrel.

21. The device of claim 17, further comprising at least one wedge disposed within the tapered bore of the barrel for securing the cable to barrel, at least a majority of the at least one wedge being disposed opposite the plate from the shoulder portion of the barrel.

22. A low-profile mine roof support device, comprising:

a plate comprising a bore and a seating surface disposed adjacent the bore, the plate adapted to be abutted against a mine roof for supporting the mine roof;

a barrel comprising a first end and a second end;

a shoulder portion disposed at the second end of the barrel and comprising a convex external surface, the convex external surface of the shoulder portion disposed in engagement with the seating surface of the plate such as to removably position the barrel within the bore of the plate;

a nose portion disposed at the first end of the barrel the nose portion comprising a tapered external surface having a diameter that is smaller than a diameter of the convex external surface of the shoulder portion such that at least a portion of the nose portion is disposed opposite the plate from the shoulder portion; and a tapered bore disposed within the barrel for receiving a cable for securing the cable in the barrel, at least a majority of the tapered bore disposed opposite the plate from the shoulder portion of the barrel.

23. The device of claim 22, wherein the entire tapered bore is disposed opposite the plate from the shoulder portion of the barrel.

24. The device of claim 22, wherein at least a majority of the nose portion of the barrel is disposed opposite the plate from the shoulder portion of the barrel.

25. The device of claim 24, wherein the entire nose portion of the barrel is disposed opposite the plate from the shoulder portion of the barrel.

26. The device of claim 22, further comprising at least one wedge disposed within the tapered bore of the barrel for securing the cable to barrel, at least a majority of the at least one wedge being disposed opposite the plate from the shoulder portion of the barrel.

27. A low-profile mine roof support device, comprising:

a plate comprising a bore and a seating surface disposed adjacent the bore, the plate adapted to be abutted against a mine roof for supporting the mine roof;

a barrel comprising a first end and a second end;

a shoulder portion disposed at the second end of the barrel and comprising a convex external surface, the convex external surface of the shoulder portion disposed in engagement with the seating surface of the plate such as to removably position the barrel within the bore of the plate;

a nose portion disposed at the first end of the barrel, the nose portion comprising an external surface having a diameter that is the smaller than a diameter of the convex external surface of the shoulder portion such that at least a portion of the nose portion is disposed opposite the plate from the shoulder portion; and a tapered bore disposed within the barrel for receiving a cable for securing the cable in the barrel, at least a majority of the tapered bore being disposed opposite the plate from the shoulder portion of the barrel, wherein the external surface of the nose portion comprises a convex external surface including a profile having a radius that is larger than a radius of a profile of the convex external surface of the shoulder portion.

28. The device of claim 27, wherein the entire tapered bore is disposed opposite the plate from the shoulder portion of the barrel.

29. The device of claim 27, wherein at least a majority of the nose portion of the barrel is disposed opposite the plate from the shoulder portion of the barrel.

30. The device of claim 29, wherein the entire nose portion of the barrel is disposed opposite the plate from the shoulder portion of the barrel.

31. The device of claim 27, further comprising at least one wedge disposed within the tapered bore of the barrel for securing the cable to barrel, at least a majority of the at least one wedge being disposed opposite the plate from the shoulder portion of the barrel.

32. A low-profile mine roof support device, comprising:

a plate comprising a bore and a seating surface disposed adjacent the bore, the plate adapted to be abutted against a mine roof for supporting the mine roof;

a barrel comprising a first end and a second end;

a shoulder portion disposed at the second end of the barrel and comprising a convex external surface, the convex external surface of the shoulder portion disposed in engagement with the seating surface of the plate such as to removably position the barrel within the bore of the plate;

a nose portion disposed at the first end of the barrel, the nose portion comprising an external surface having a diameter that is the smaller than a diameter of the convex external surface of the shoulder portion such that at least a portion of the nose portion is disposed opposite the plate from the shoulder portion; and a tapered bore disposed within the barrel for receiving a cable for securing the cable in the barrel, at least a majority of the tapered bore disposed opposite the plate from the shoulder portion of the barrel, wherein the shoulder portion of the barrel further comprises one of a recess for receiving an internal drive mechanism and a nut for receiving an external drive mechanism.

33. The device of claim 32, wherein the entire tapered bore is disposed opposite the plate from the shoulder portion of the barrel.

34. The device of claim 32, wherein at least a majority of the nose portion of the barrel is disposed opposite the plate from the shoulder portion of the barrel.

35. The device of claim 34, wherein the entire nose portion of the barrel is disposed opposite the plate from the shoulder portion of the barrel.

36. The device of claim 32, further comprising at least one wedge disposed within the tapered bore of the barrel for securing the cable to barrel, at least a majority of the at least one wedge being disposed opposite the plate from the shoulder portion of the barrel.

37. A low-profile mine roof support device, comprising:

a plate comprising a first surface, a second surface that is opposite the first surface, a bore extending between the first and second surfaces, and a seating surface disposed between the second surface and the bore, the first surface of the plate adapted to be abutted against a mine roof;

a barrel comprising a first end and a second end;

a nose portion disposed at the first end of the barrel;

a shoulder portion disposed at the second end of the barrel and comprising a convex external surface with an average diameter that is greater than an average diameter of the nose portion, the convex external surface disposed in contact with the seating surface of the plate such that the shoulder portion intersects the second surface of the plate; and a tapered bore disposed completely within the nose portion of the barrel and converging away from the plate and the shoulder portion, the tapered bore adapted to receive a cable and at least one wedge for securing the cable in the barrel and the plate against the mine roof.

38. The device of claim 37, wherein at least a majority of the nose portion of the barrel is disposed opposite the plate from the shoulder portion.

39. The device of claim 38, wherein the entire nose portion of the barrel is disposed opposite the plate from the shoulder portion.

40. The device of claim 37, wherein at least a majority of the tapered bore is disposed opposite the plate from the shoulder portion.

41. The device of claim 40, wherein the entire tapered bore is disposed opposite the plate from the shoulder portion.

42. The device of claim 37, further comprising at least one wedge disposed within the tapered bore of the nose portion of the barrel for securing the cable to barrel, at least a majority of the at least one wedge being disposed opposite the plate from the shoulder portion of the barrel.

43. The device of claim 37, wherein the tapered bore begins converging at a location disposed within the bore of the plate to a location adjacent the first end of the barrel.

44. The device of claim 37, wherein the nose portion of the barrel comprises a tapered external surface.

45. The device of claim 44, wherein the nose portion comprises a convex external surface.

46. The device of claim 45, wherein the convex external surface of the nose portion of the barrel comprises a profile having a radius that is larger than a radius of a profile of the convex external surface of the shoulder portion.

47. The device of claim 37, further comprising at least one wedge disposed within the tapered bore of the nose portion of the barrel for securing the cable to barrel, at least a majority of the at least one wedge being disposed opposite the plate from the shoulder portion of the barrel.

48. The device of claim 37, wherein the shoulder portion of the barrel further comprises one of a recess for receiving an internal drive mechanism and a nut for receiving an external drive mechanism.

* * * * *